US010222069B2

(12) United States Patent
Duffy et al.

(10) Patent No.: US 10,222,069 B2
(45) Date of Patent: Mar. 5, 2019

(54) SLIDING ORIFICE HOLDER FOR A GAS POWERED COOKTOP

(71) Applicant: WHIRLPOOL CORPORATION, Benton Harbor, MI (US)

(72) Inventors: Patrick J. Duffy, St. Joseph, MI (US); Anthony S. Roberts, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 400 days.

(21) Appl. No.: 15/213,992

(22) Filed: Jul. 19, 2016

(65) Prior Publication Data

US 2018/0023815 A1 Jan. 25, 2018

(51) Int. Cl.

| | |
|---|---|
| ***F24C 3/08*** | (2006.01) |
| *F23D 14/58* | (2006.01) |
| *F23D 14/06* | (2006.01) |

(52) U.S. Cl.
CPC ..... *F24C 3/085* (2013.01); *F23D 14/06* (2013.01); *F23D 14/58* (2013.01)

(58) Field of Classification Search
CPC ..... F24C 3/08; F23D 14/58; F23D 14/06
USPC ..... 126/39 E, 39 H, 214 A
See application file for complete search history.

(56) References Cited

U.S. PATENT DOCUMENTS

| | | | | |
|---|---|---|---|---|
| 4,773,384 | A | 9/1988 | Koziol | |
| 4,861,264 | A | 8/1989 | Romanak et al. | |
| 5,623,917 | A * | 4/1997 | Dinaso | F23D 14/06 126/39 H |
| 5,676,539 | A | 10/1997 | Draper | |
| 9,022,780 | B2 | 5/2015 | Padgett | |
| 9,541,294 | B2 * | 1/2017 | Angulo | F24C 3/08 |
| 9,784,454 | B2 * | 10/2017 | Kadus | F24C 3/085 |
| 9,982,888 | B2 * | 5/2018 | Angulo | F24C 3/08 |
| 9,995,482 | B2 * | 6/2018 | Cadima | F23D 14/84 |
| 2013/0306055 | A1 * | 11/2013 | Cadima | F24C 3/085 126/39 E |
| 2014/0261385 | A1 | 9/2014 | Kadus et al. | |

* cited by examiner

*Primary Examiner* — Gregory Huson
*Assistant Examiner* — Nikhil Mashruwala
(74) *Attorney, Agent, or Firm* — Price Heneveld LLP

(57) ABSTRACT

A heating appliance includes a cooktop having a plurality of burners. A burner box defines a burner position for each burner, each burner position having a plurality of slots. An orifice holder is slidably engaged with the plurality of slots in a linear direction. Opposing flanges extend from a bottom portion of the orifice holder that extend through the plurality of slots to be at least partially secured therein, wherein the opposing flanges are adapted to engage the plurality of slots in only one directional orientation.

12 Claims, 9 Drawing Sheets

SLIDING ORIFICE HOLDER FOR A GAS POWERED COOKTOP

FIELD OF THE DEVICE

The device is in the field of gas powered cooking appliances, and more specifically, a sliding orifice holder to assist in the installation of a burner for a gas powered cooking appliance.

SUMMARY

In at least one aspect, a heating appliance includes a cooktop having a plurality of burners. A burner box defines a burner position for each burner, each burner position having a plurality of slots. An orifice holder is slidably engaged with the plurality of slots in a linear direction. Opposing flanges extend from a bottom portion of the orifice holder and extend through the plurality of slots to be at least partially secured therein, wherein the opposing flanges are adapted to engage the plurality of slots in only one directional orientation.

In at least another aspect, a method for assembling a burner for a cooking appliance includes steps of positioning an orifice holder proximate a plurality of slots within a burner position of a burner box, aligning the orifice holder such that opposing flanges of the orifice holder correspond to the respective slots of the plurality of slots, passing the opposing flanges through an enlarged area of each respective slot and sliding the opposing flanges in a linear direction through a narrowed portion of the respective slots and into a securing position. The orifice holder is at least partially secured in the narrowed portion.

In at least another aspect, a method for assembling a burner for a cooking appliance includes steps of positioning an orifice holder proximate a pair of corresponding slots within a burner position of a burner box, aligning the orifice holder such that opposing flanges of the orifice holder correspond to respective slots of the pair of slots, wherein one of the flanges of the opposing flanges is adapted to only pass through one slot of the pair of slots and is further adapted to be free of passage through the other slot of the pair of slots, wherein alignment of the opposing flanges and the pair of slots defines a single orientation of the orifice holder with respect to the burner position, passing the opposing flanges through an enlarged area of each respective slot of the pair of slots and sliding the opposing flanges in a linear direction through a narrowed portion of the respective slots and into a securing position. The orifice holder is at least partially secured in the narrowed portion.

These and other features, advantages, and objects of the present device will be further understood and appreciated by those skilled in the art upon studying the following specification, claims, and appended drawings.

DETAILED DESCRIPTION OF EMBODIMENTS

Figure 1:
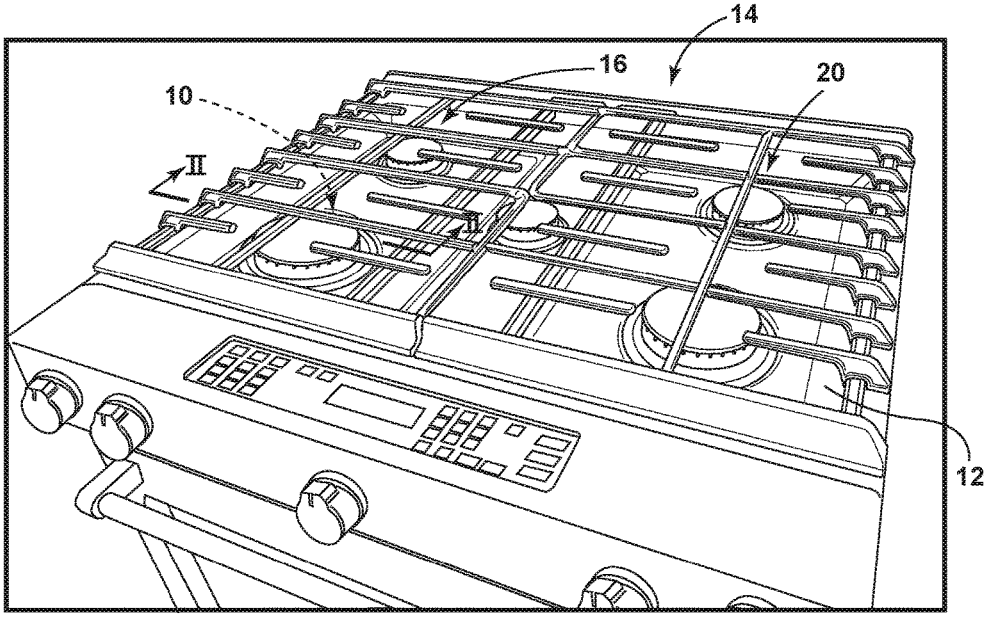
FIG. 1 is a top perspective view of a cooking appliance incorporating an aspect of the sliding orifice holder.
Figure 2:
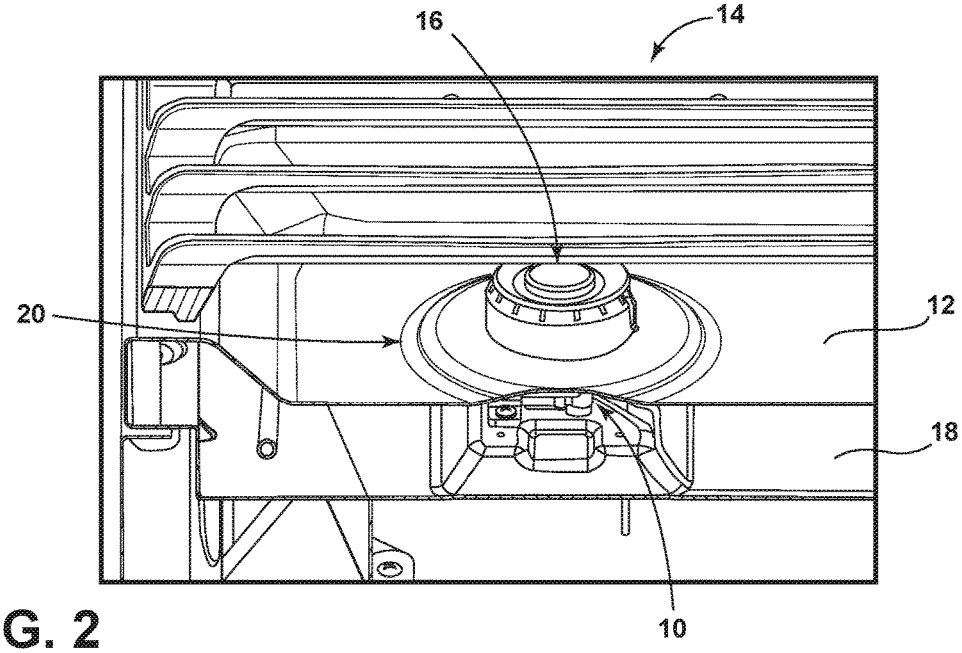
FIG. 2 is a cross-sectional view of a burner of the gas powered cooking appliance of FIG. 1 taken along line II-II.
Figure 3:
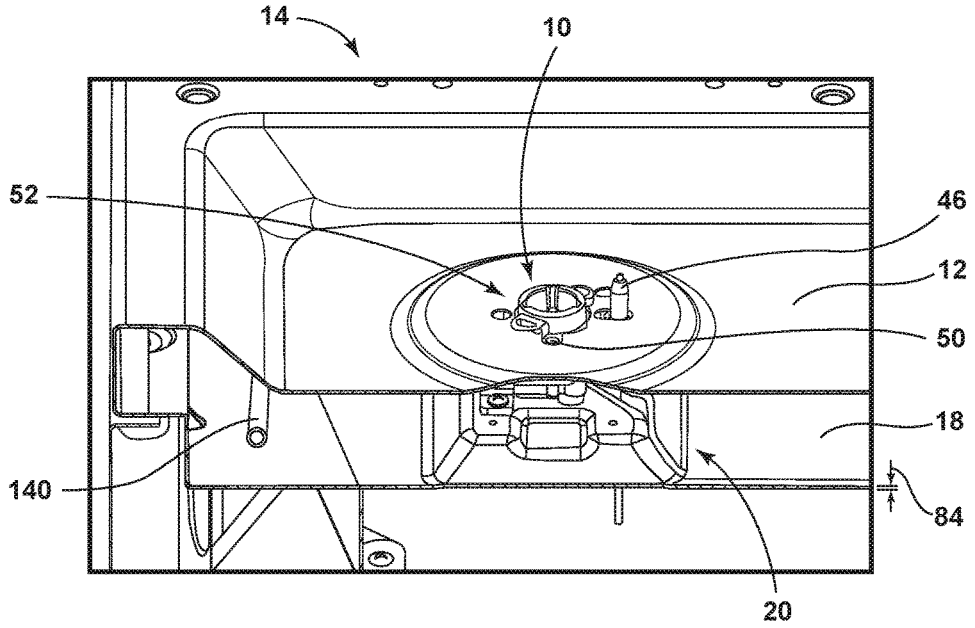
FIG. 3 is a cross-sectional view of the cooking appliance of FIG. 2 with the cooking grate removed.
Figure 4:
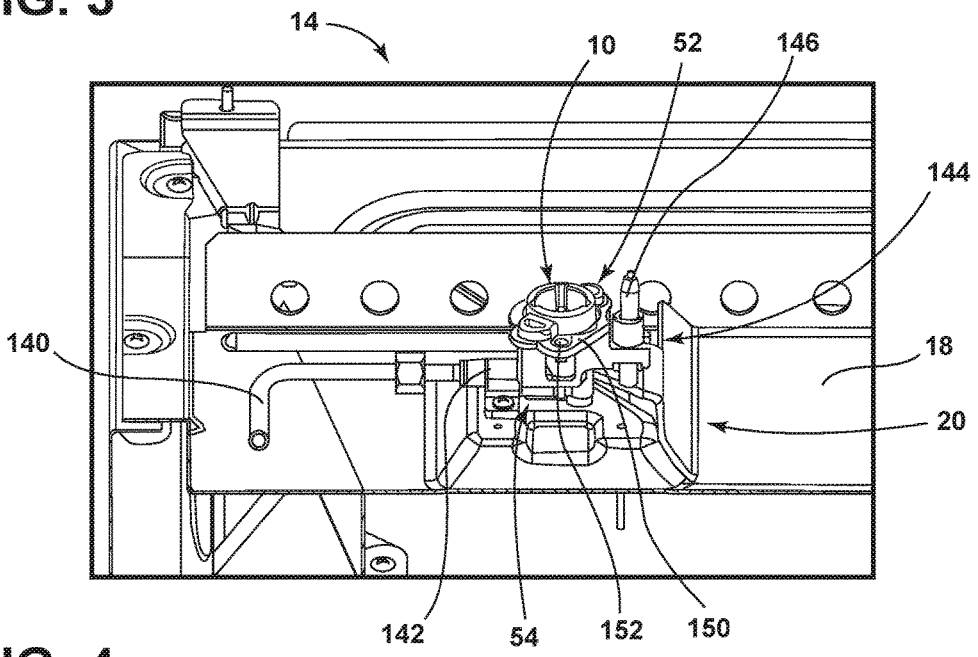
FIG. 4 is a cross-sectional view of the cooking appliance of FIG. 3 with the cooktop removed and exposing the orifice holder installed within the burner box.
Figure 7:
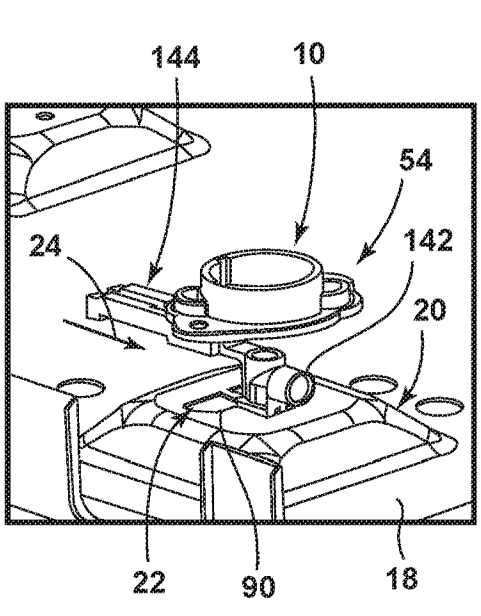
FIG. 7 is a top perspective view of the burner position of FIG. 6 with the orifice holder moved into a securing position within the pair of corresponding slots.
Figure 6:
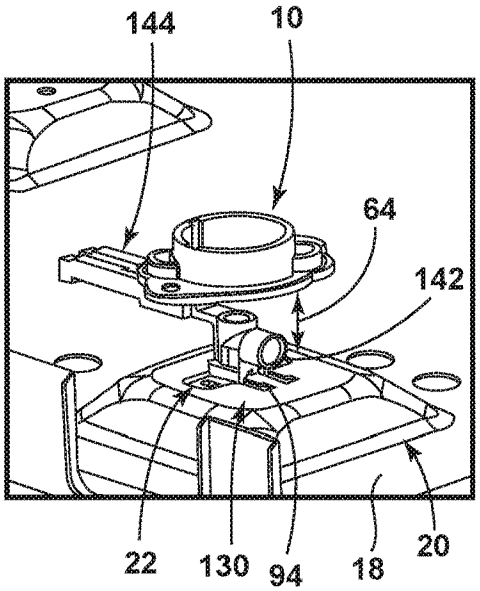
FIG. 6 is a top perspective view of the cooking appliance of FIG. 5 showing the opposing flanges inserted through the pair of corresponding slots.
Figure 5:
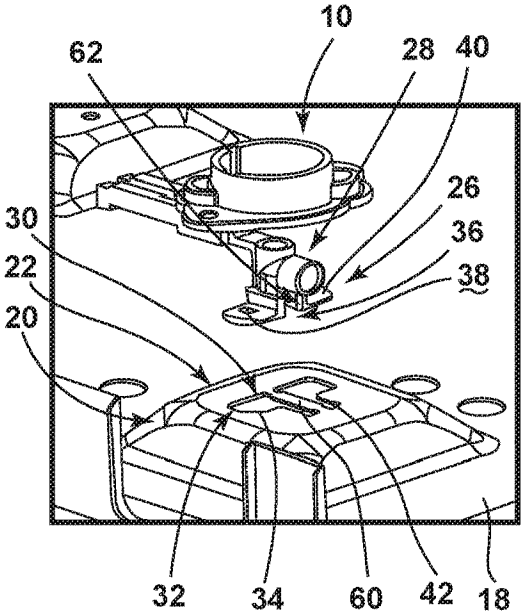
FIG. 5 is a partially exploded perspective view of a sliding orifice holder positioned above a burner position.
Figure 8:
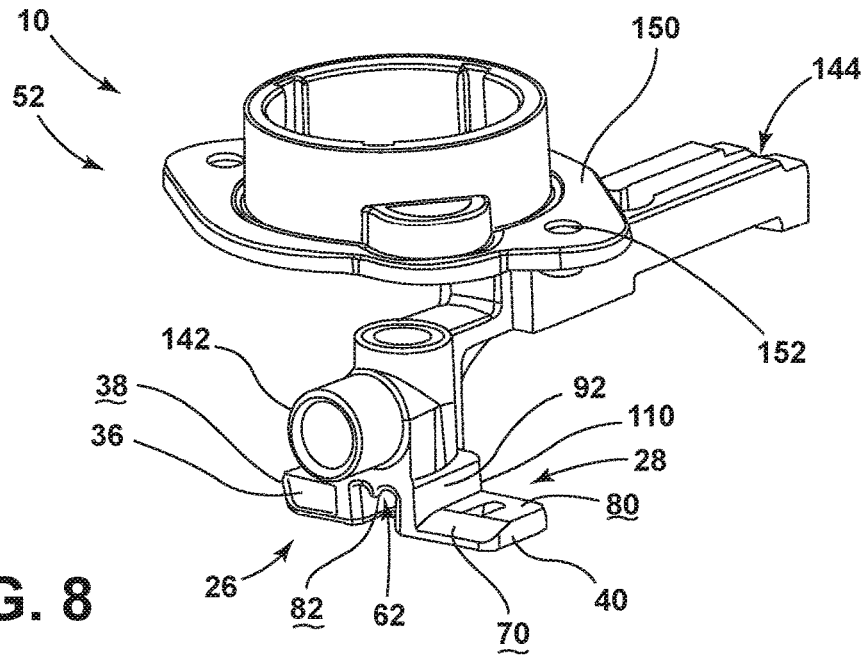
FIG. 8 is a top perspective view of the burner position of FIG. 7 with the cooktop positioned over the sliding orifice holder.
Figure 9:
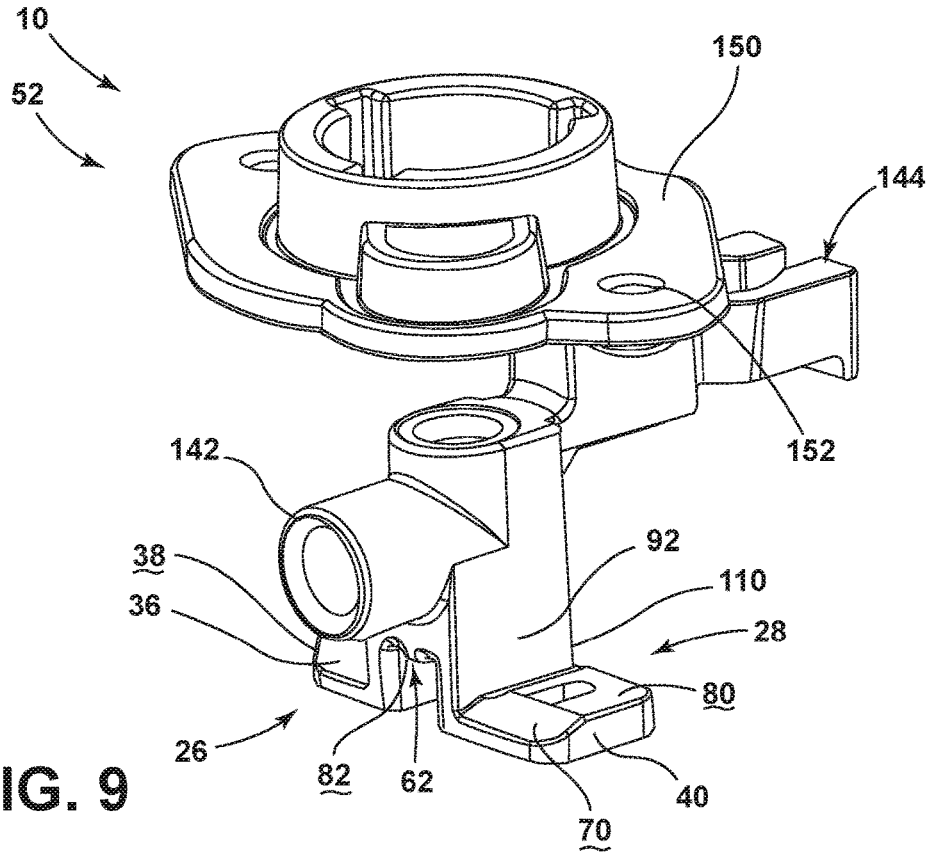
FIG. 9 is a perspective view of an aspect of the sliding orifice holder.
Figure 10:
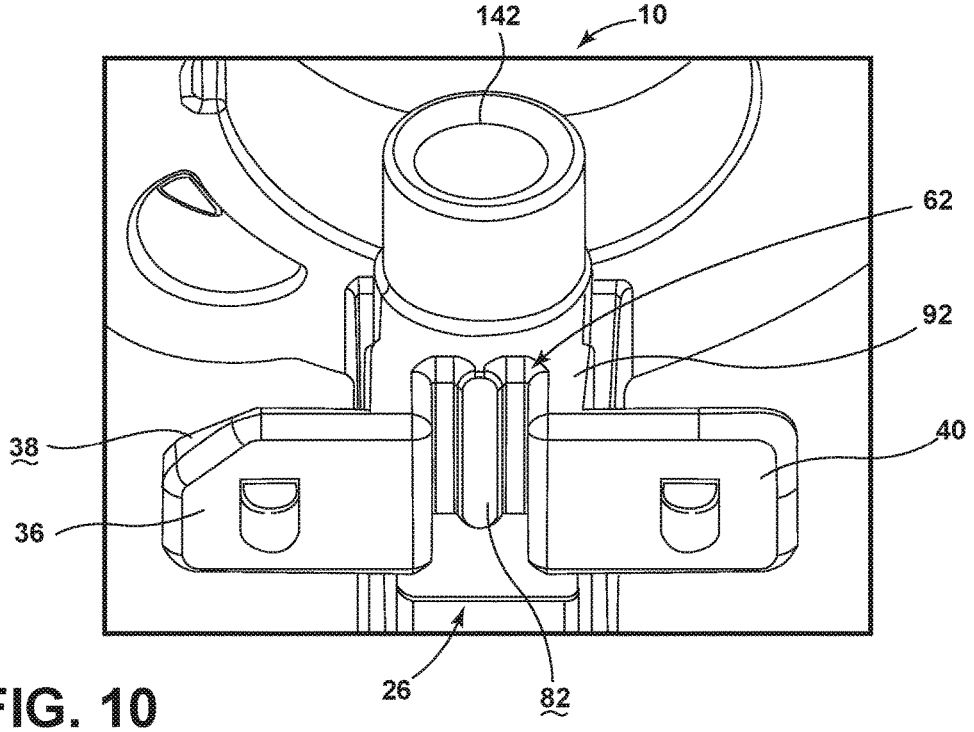
FIG. 10 is a bottom perspective view of the opposing flanges of an aspect of the sliding orifice holder.
Figure 11:
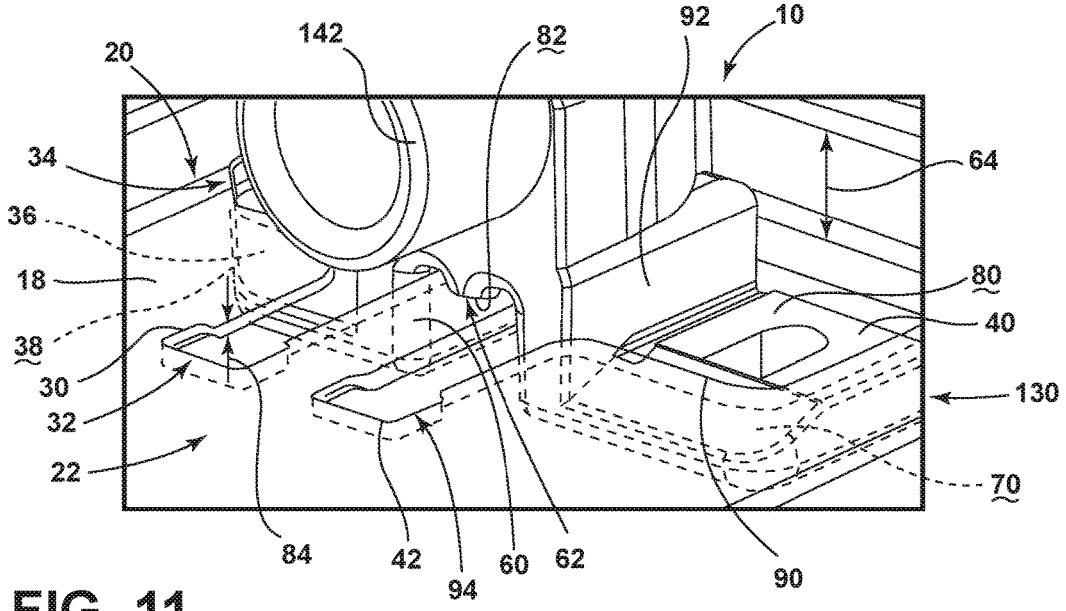
FIG. 11 is a perspective view of an aspect of the sliding orifice holder.
Figure 13:
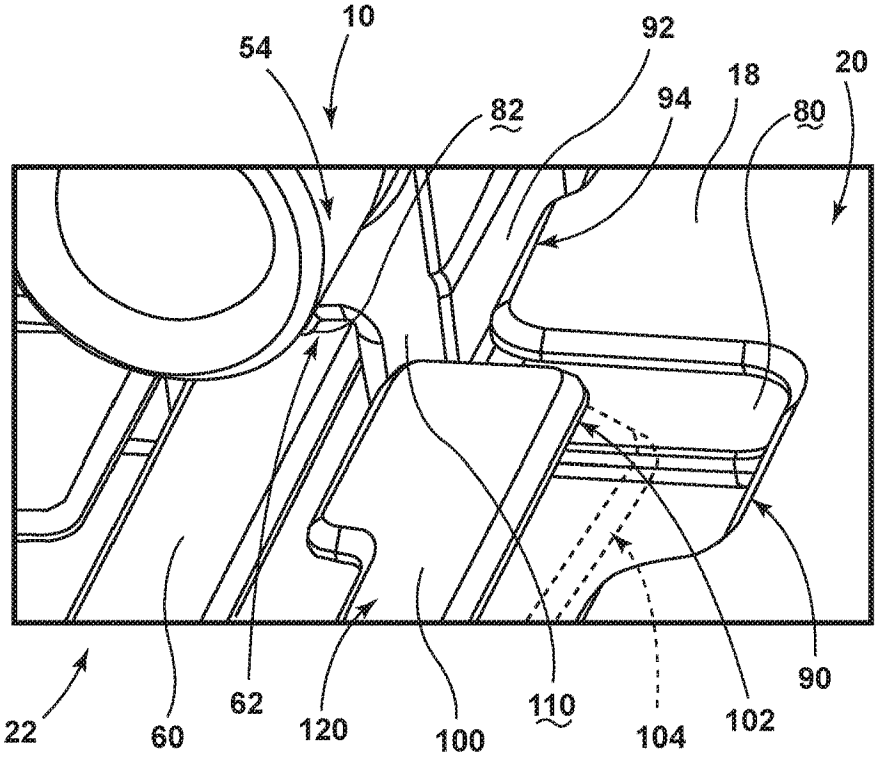
FIG. 13 is a top perspective view of an aspect of the sliding orifice holder inserted within the corresponding pair of slots defined within a burner position.
Figure 12:
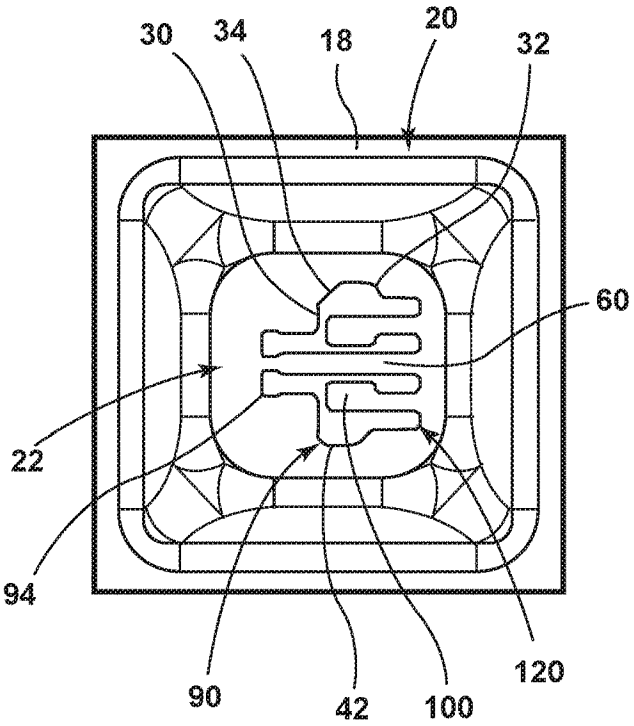
FIG. 12 is a top plan view of an aspect of a burner position defined within a burner box.
Figure 16:
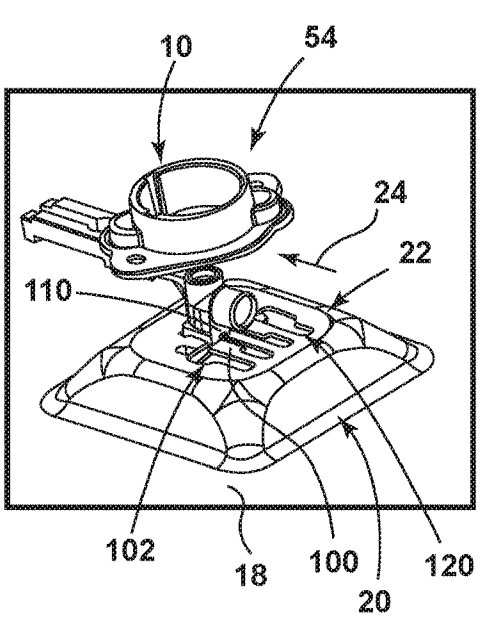
FIG. 16 is a top perspective view of the burner position of FIG. 15 showing the opposing flanges inserted through the corresponding pair of slots and in the securing position.
Figure 15:
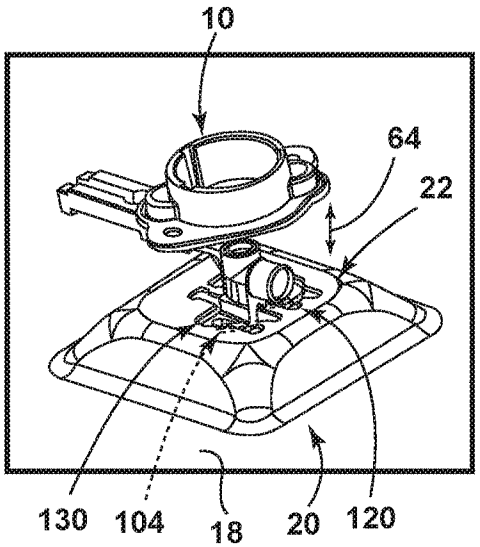
FIG. 15 is a top perspective view of the burner position of FIG. 13 showing the orifice holder positioned within the pair of corresponding slots.
Figure 14:
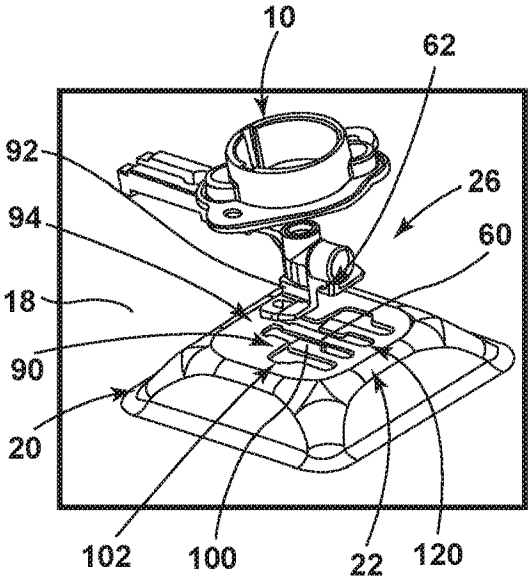
FIG. 14 is a top perspective view of an aspect of the burner position of FIG. 13 with a sliding orifice holder positioned above the pair of corresponding slots.
Figure 17:
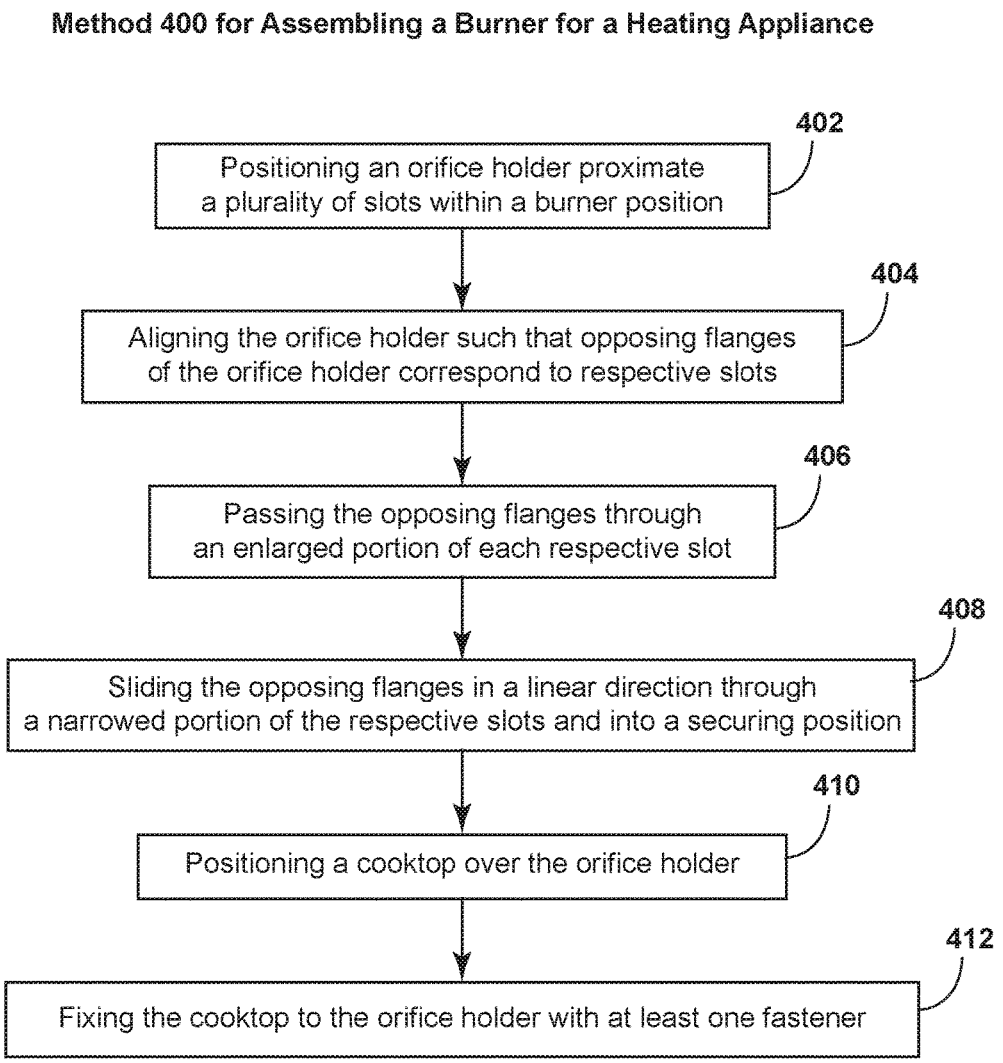
FIG. 17 is a schematic flow diagram illustrating a method for assembling a burner for a cooking appliance.
Figure 18:
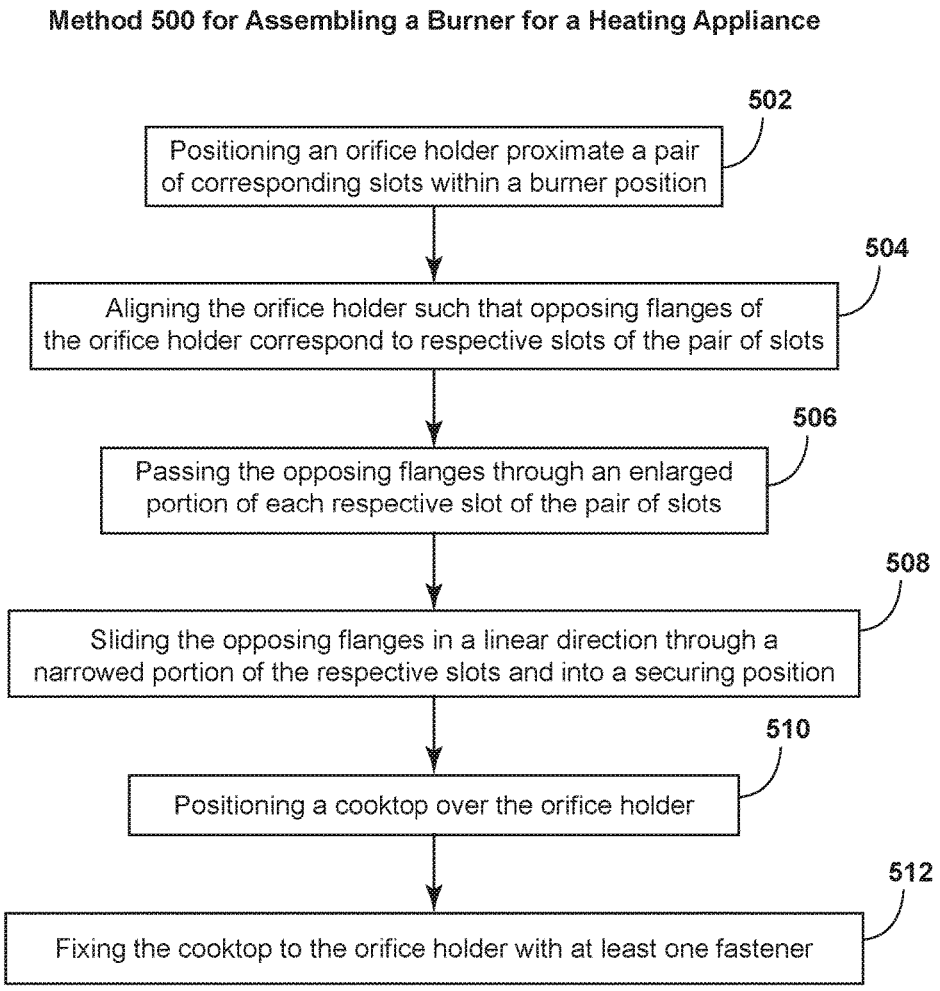
FIG. 18 is a schematic flow diagram illustrating a method for assembling a burner for a cooking appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-12, reference numeral 10 generally refers to a sliding orifice holder that is disposed within a gas powered cooktop 12 within a heating appliance 14. According to the various aspects of the device, the heating appliance 14 can include a cooktop 12 having a plurality of burners 16 and a burner box 18 that defines a burner position 20 for each burner 16. Each burner position 20 is configured to include a plurality of slots 22. The orifice holder 10 is slidably engaged with the plurality of slots 22 in a linear direction 24. Opposing flanges 26 are adapted to extend from a bottom portion 28 of the orifice holder 10. The opposing flanges 26 extend through the plurality of slots 22 to be at least partially secured therein. It is contemplated that the opposing flanges 26 are adapted to engage the plurality of slots 22 in only one directional orientation. It is further contemplated that the plurality of slots 22 can include a pair of corresponding slots 22 that match the opposing flanges 26 extending from the bottom portion 28 of the orifice holder 10.

Referring again to FIGS. 1-12, in order to achieve the single directional orientation of the orifice holder 10 within the plurality of slots 22, at least one slot 22, such as a first slot 30 of the plurality of slots 22, can include an aperture 32 having a locating feature 34. Similarly, at least one of the flanges of the opposing flanges 26, a first flange 36, can include a locating surface 38 that corresponds to the locating feature 34 defined within the aperture 32 for the first slot 30 of the plurality of slots 22. In this manner, one of the opposing flanges 26 is adapted to fit into only one, and not the other, of the pair of corresponding slots 22. Due to the configuration of the locating feature 34 of the aperture 32 of one of the slots 22 and the locating surface 38 of the corresponding flange of the opposing flanges 26, the orifice holder 10 can be placed through the pair of corresponding slots 22 in a single orientation. Rotation of the orifice holder 10 by 180° or other angular direction will result in the second flange 40 of the opposing flanges 26, not having the locating surface 38, being prevented from passing through the first slot 30 having the locating feature 34. As exemplified, the locating feature 34 can be a chamfer defined within the aperture 32 of the first slot 30 of the pair of corresponding slots 22. Similarly, as exemplified, the locating surface 38 can be a chamfered corner of the first flange 36 of the pair of opposing flanges 26 of the orifice holder 10. Accordingly, the first flange 36 can only go through the first slot 30 such that the second flange 40 can only pass through the second slot 42.

During installation of the orifice holder 10 within the pair of corresponding slots 22, engagement of the pair of opposing flanges 26 within the plurality of slots 22, or the pair of opposing slots 22, defines a loose connection of the orifice holder 10 within the particular burner position 20. It is contemplated that the connection between the orifice holder 10 and the burner box 18 is supplemented by at least one fastener 50 that extends through a cooktop 12 and into the upper portion 52 of the orifice holder 10 to attach or affix the cooktop 12 to the orifice holder 10. Accordingly, during manufacture of the heating appliance 14, the opposing flanges 26 of the orifice holder 10 can be slidably engaged within the pair of corresponding slots 22 and at least partially secured therein to define a securing position 54 of the orifice holder 10 within the pair of corresponding slots 22. As the heating appliance 14 is moved through the steps and processes of manufacture, such as along an assembly line, the orifice holder 10 is substantially retained within the pair of corresponding slots 22. Accordingly, movement of the at least partially assembled cooktop 12 will not substantially result in the orifice holders 10 sliding out of or falling from the burner position 20 during assembly.

According to the various embodiments, the connection of the pair of opposing flanges 26 with the corresponding pair of slots 22 within the burner position 20 defines an at least partial engagement between the orifice holder 10 and the burner box 18, such that an individual assembling a heating appliance 14 does not have to hold the orifice holder 10 in a particular position during assembly of the cooktop 12 over the orifice holder 10. This attachment can be a substantially hands-free operation such that one person, by himself or herself, can place the cooktop 12 over the one or more orifice holders 10 and attach or affix fasteners 50 through the cooktop 12 and into the respective orifice holders 10 during assembly of the heating appliance 14. This configuration can save time and resources during the assembly of the heating appliance 14.

Referring again to FIGS. 5-12, the plurality of slots 22 within the burner position 20 can include two opposing slots 22 that are separated by a linear guide 60. Similarly, the pair of opposing flanges 26 can be separated by a corresponding linear channel 62 that substantially matches the shape and profile of the linear guide 60. It is contemplated that the engagement of the linear channel 62 with the linear guide 60 during installation of the orifice holder 10 within the pair of opposing slots 22 limits the perpendicular movement 64 of the opposing flanges 26 through the slots 22. Accordingly, as the pair of opposing flanges 26 moves through the pair of corresponding slots 22, engagement of the linear channel 62 between the pair of opposing flanges 26 with the linear guide 60 defined between the corresponding pair of slots 22 stops the perpendicular movement 64 of the opposing flanges 26 through the slots 22 and sets the vertical position of the sliding orifice holder 10 within the burner position 20. It is contemplated that the securing position 54 of the orifice holder 10 and, in turn, the pair of opposing flanges 26, is defined by the linear channel 62 of the orifice holder 10 engaging the burner box 18 from above, and the opposing flanges 26 of the orifice holder 10 engaging the burner box 18 from below. In this manner, the sliding orifice holder 10 can be retained, or substantially retained, within the burner position 20 during assembly of the heating appliance 14.

Referring again to FIGS. 5-12, it is contemplated that each of the pair of opposing flanges 26 can include an angled leading surface that is adapted to slidably engage the aperture 32 of each of the pair of respective slots 22. Accordingly, the first and second flanges 36, 40 of the pair of opposing flanges 26 include the angled leading surface that engages the corresponding apertures 32 of the first and second slots 30, 42 of the pair of respective slots 22 within a burner position 20. In this manner, the engagement of the angled leading surface with the respective aperture 32 promotes the sliding movement in a linear direction 24 of the opposing flanges 26 into the securing position 54. Stated another way, the engagement of the linear channel 62 with the linear guide 60 places at least a portion of the angled leading surface completely through the aperture 32 of each of the first and second slots 30, 42 such that the angled leading surface can engage the burner box 18 from below. This engagement promotes a convenient sliding movement of the orifice holder 10. It is also contemplated that the distance between a top surface 80 of the pair of opposing flanges 26 and a bottom surface 82 of the linear channel 62 is the same distance as the thickness 84 of the burner box 18. Accordingly, the bottom surface 82 of the linear channel 62 and the top surface 80 of the first and second flanges 36, 40 provides a frictional fit around the pair of opposing slots 22 of the burner box 18 to substantially retain the sliding orifice holder 10 within the burner position 20. It is also contemplated that the distance between the bottom of the linear channel 62 and the top surface 80 of the pair of opposing flanges 26 can be slightly smaller than the thickness 84 of the burner box 18, such that the sliding orifice holder 10 can at least partially bias portions of the burner position 20 to allow for the sliding movement of the sliding orifice holder 10 in the linear direction 24. The biasing movement of the burner position 20 against the bottom surface 82 of the linear channel 62 and top surface 80 of the opposing flanges 26 provides a greater frictional fit and substantially retains the sliding orifice holder 10 in the securing position 54 within the burner position 20.

Referring again to FIGS. 5-12, it is contemplated that each of the pair of respective slots 22 can include an enlarged portion 90 that is substantially the same shape as the pair of opposing flanges 26, respectively. As discussed above, the locating feature 34 defined within the aperture 32 of one of the slots 22 can be defined within the enlarged portion 90 of one of the first and second slots 30, 42 of the pair of respective slots 22 within the burner position 20. As the orifice holder 10 moves in the linear direction 24 through the pair of corresponding slots 22, vertical portions 92 of the pair of opposing flanges 26 move through linear narrowed portions 94 of each of the slots 22. Movement of the vertical portions 92 of the pair of opposing flanges 26 into the narrowed portions 94 allows for movement in the linear direction 24 of the pair of opposing flanges 26 under the burner box 18 and into the securing position 54.

Referring now to FIGS. FIGS. 12-16, it is contemplated that each of the first and second slots 30, 42 of the pair of corresponding slots 22 can include at least one deflecting tab 100. Each deflecting tab 100 is adapted to be biased downward from a retaining state 102 to an entry state 104 when a pair of opposing flanges 26 are disposed in a substantially perpendicular movement 64 through the slots 22 and toward the securing position 54. Once the pair of opposing flanges 26 are moved in the linear direction 24 through the narrowed portion 94 of the slots 22 and toward the securing position 54, the deflecting tabs 100 return to the retaining state 102 when the opposing flanges 26 are fully in the securing position 54. In this manner, the deflecting tabs 100 serve to retain the opposing flanges 26 in the securing position 54. Additionally, the deflecting tabs 100 in the retaining state 102 engage a rear surface 110 of each of the first and second flanges 36, 40 of the pair of opposing flanges 26 to prevent movement of the pair of opposing flanges 26 out of the securing position 54 within the narrowed portions 94 of the slots 22.

According to the various embodiments, it is contemplated that the deflecting tabs 100 can be positioned to extend through a portion of the enlarged portion 90 of each of the first and second slots 30, 42. It is also contemplated that only one of the first and second slots 30, 42 may include a deflecting tab 100 where the single deflecting tab 100 is adapted to retain the sliding orifice holder 10 in the securing position 54. It is contemplated that the deflecting tabs 100 can be an integral portion of the burner box 18 or can be a separate piece attached to the burner box 18 to extend through the enlarged portion 90 of at least one of the first and second slots 30, 42 within the burner position 20. Where a deflecting tab 100 is included, each of the first and second slots 30, 42 that incorporates a deflecting tab 100 can include a deflecting region 120 that allows for the deflecting tab 100 to deflect a sufficient distance as the respective flange of the first and second flanges 36, 40 moves through the corresponding slot 22.

Referring now to FIGS. 1-17, having described the various aspects of the sliding orifice holder 10 being disposed within a burner position 20 for a heating appliance 14, a method 400 is disclosed for assembling a burner 16 for a heating appliance 14. According to the method 400, an orifice holder 10 is positioned proximate a plurality of slots 22 within a burner position 20 of a burner plate or burner box 18 (step 402). As discussed above, the plurality of slots 22 can include a pair of corresponding slots 22 that match the shape and configuration of the pair of opposing flanges 26 of the sliding orifice holder 10. The sliding orifice holder 10 is aligned such that the pair of opposing flanges 26 of the orifice holder 10 corresponds to the respective slots 22 of the plurality of slots 22 (step 404). The pair of opposing flanges 26 are passed through the enlarged portion 90 of each respective slot 22 (step 406). The opposing flanges 26 are then slid in a linear direction 24 through a narrowed portion 94 of each of the respective slots 22 and into the securing position 54. The narrowed portion 94 of each of the opposing slots 22 extends from the enlarged portion 90 of each respective slot 22. The orifice holder 10 is then at least partially secured within the narrowed portion 94 of each of the pair of corresponding slots 22 (step 408).

Referring again to FIGS. 1-17, the method 400 also includes a step 410 of positioning a cooktop 12 over the orifice holder 10, wherein a portion of the orifice holder 10 extends through the cooktop 12. The cooktop 12 can then be fixed to the orifice holder 10 with at least one fastener 50, wherein the attachment of the cooktop 12 with the orifice holder 10 defines a fixed engagement between the orifice holder 10 and the burner plate 18 (step 412).

Referring again to FIGS. 1-17, it is contemplated that the step 406 of passing the opposing flanges 26 through the enlarged portion 90 of each respective slot 22 can include engaging the opposing flanges 26 with at least one deflecting tab 100 to bias the deflecting tab 100 from a retaining state 102 to an entry state 104. In this manner, the opposing flanges 26 are able to be disposed through the respective slots 22 when the at least one deflecting tab 100 is in the entry state 104. The at least one deflecting tab 100 is adapted to return to the retaining state 102 when the opposing flanges 26 are in the securing position 54. In this manner, the at least one deflecting tab 100 serves to retain the opposing flanges 26 in the securing position 54 to prevent movement of the opposing flanges 26 out of the securing position 54. Additionally, the step 402 of aligning the orifice holder 10 includes positioning a locating surface 38 of one of the flanges with a corresponding locating feature 34 that at least partially defines one of the slots 22 of the plurality of slots 22. It is contemplated that the alignment of the locating surface 38 of the locating feature 34 defines a single orientation of the orifice holder 10 with respect to the burner position 20.

It is also contemplated that the step 406 of passing the opposing flanges 26 through the enlarged portion 90 of each respective slot 22 includes engaging a linear channel 62 defined between the opposing flanges 26 with the linear guide 60 defined between the pair of corresponding slots 22. In this manner, engagement of the linear channel 62 with the linear guide 60 defines a maximum insertion depth 130 of the opposing flanges 26 through the enlarged portion 90 of each of the pair of corresponding slots 22. It is further contemplated that the maximum insertion depth 130 is defined by the opposing flanges 26 passing substantially through the respective slots 22 such that the angled leading surface of each of the opposing flanges 26 is positioned entirely through the apertures 32 of the pair of corresponding slots 22.

Referring now to FIGS. 1-16 and 18, a method 500 is disclosed for assembling a burner 16 for a cooking appliance. The method 500 includes step 502 that includes positioning an orifice holder 10 proximate a pair of corresponding slots 22 within a burner position 20 of a burner plate or burner box 18. The method 500 also includes a step 504 of aligning the orifice holder 10 such that the opposing flanges 26 of the orifice holder 10 correspond to respective slots 22 of the pair of corresponding slots 22. In this manner, one of the flanges of the pair of opposing flanges 26 is adapted to pass only through one slot 22 of a pair of slots 22 and is further adapted to be free of passage, or is incapable of passage, through the other slot 22 of the pair of slots 22. Accordingly, alignment of the opposing flanges 26 and the pair of slots 22 defines a single orientation of the orifice holder 10 with respect to the burner position 20. Once the orifice holder 10 is aligned, the opposing flanges 26 are passed in a perpendicular movement 64 through an enlarged portion 90 of each of the respective slots 22 of the pair of slots 22 (step 506). The opposing flanges 26 are then slid in a linear direction 24 through the narrowed portion 94 of the respective slots 22 and into the securing position 54 (step 508). In this manner, the orifice holder 10 is at least partially secured in the narrowed portion 94 of the pair of corresponding slots 22. A cooktop 12 is then positioned over the orifice holder 10 (step 510). A portion of the orifice holder 10 is adapted to extend through the cooktop 12. The cooktop 12 is then fixed to the orifice holder 10 with at least one fastener 50 (step 512). The attachment of the cooktop 12 to the orifice holder 10 defines a fixed engagement between the orifice holder 10 and the burner box 18.

Referring again to FIGS. 1-4, it is contemplated that assembly of the orifice holder 10 within the heating appliance 14 can include positioning a fuel line 140 to an inlet portion 142 of the orifice holder 10. The securing position 54 of the orifice holder 10 within the burner position 20 can assist the assembler in manufacturing the heating appliance 14 in that the securing position 54 of the orifice holder 10 substantially retains the fuel line 140 in a fixed position and prevents unnecessary movement of the sliding orifice holder 10 within the burner position 20. Additionally, linear movement of the sliding orifice holder 10 can allow for the fuel line 140 to be inserted first before the sliding orifice holder 10 is inserted within the pair of corresponding slots 22 of the burner position 20. The linear movement of the sliding orifice holder 10 to be moved into the securing position 54 is a limited linear movement that is capable of being achieved while a rigid fuel line 140 passing through portions of the heating appliance 14 is engaged with the inlet portion 142. The sliding orifice holder 10 can also include an igniter portion 144 that is adapted to receive and retain the igniter 146 for each burner position 20. As with the fuel line 140, the igniter 146 can be installed within the igniter portion 144 either before or after the sliding orifice holder 10 is installed within the burner position 20. Again, the limited movement in the linear direction 24 of the sliding orifice holder 10, in conjunction with the limited vertical or perpendicular movement 64 of the sliding orifice holder 10 through the pair of corresponding slots 22, provides for pre-installation of the fuel line 140 and the igniter 146. This ability to pre-install the igniter 146 and fuel line 140 makes assembly of the heating appliance 14 more efficient.

According to the various embodiments, it is contemplated that the sliding orifice holder 10 can be disposed within the burner box 18 at a single location. The burner box 18 with the sliding orifice holder 10 is thereby retained therein in a securing position 54 and can be transported to a separate location for installation of the igniter 146 and fuel line 140 as well as the cooktop 12 for final assembly or nearly final assembly of the heating appliance 14.

In order to secure the cooktop 12 to the sliding orifice holder 10, the sliding orifice holder 10 can include a top flange 150 having one or more fastening apertures 152 that receive a fastener 50 through the cooktop 12 for securing the sliding orifice holder 10 to the cooktop 12.

It is contemplated that engagement of the sliding orifice holder 10 with the pair of corresponding slots 22 within the burner position 20 is intended to be a temporary engagement that requires final securing by fasteners 50 to the cooktop 12. The degree of securing attachment between the sliding orifice holder 10 and the pair of corresponding slots 22 can vary. However, the degree of attachment between the sliding orifice holder 10 and the pair of corresponding slots 22, according to the various embodiments, is such that when the sliding orifice holders 10 are in the securing position 54, the burner box 18 and the sliding orifice holders 10 contained therein can be transported from one location to another without the sliding orifice holders 10 becoming dislodged from the securing position 54, inadvertently. Accordingly, a limited amount of wobble of the sliding orifice holders 10 within the pair of corresponding slots 22 is contemplated, in certain embodiments. In other embodiments, very limited or no wobble is defined between the engagement of the sliding orifice holders 10 and the pair of corresponding slots 22. The inclusion of the deflecting tabs 100 provides for greater degrees of securing attachment between the sliding orifice holders 10 and the burner box 18.

The overall design of the sliding orifice holders 10 and the engagement with the pair of corresponding slots 22 is intended to limit the number of workers necessary to assemble a heating appliance 14 and make the assembly of the heating appliance 14 a more efficient operation, thereby limiting cost and resources.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for assembling a burner for a cooking appliance, the method comprising steps of:

positioning an orifice holder proximate a plurality of slots within a burner position of a burner box;

aligning the orifice holder such that opposing flanges of the orifice holder correspond to the respective slots of the plurality of slots;

passing the opposing flanges through an enlarged portion of each respective slot; and sliding the opposing flanges in a linear direction through a narrowed portion of the respective slots in only one direction and into a securing position, wherein the orifice holder is at least partially secured in the narrowed portion.

2. The method of claim 1, further comprising steps of:

positioning a cooktop over the orifice holder, wherein a portion of the orifice holder extends through the cooktop; and affixing the cooktop to the orifice holder with at least one fastener, wherein attachment of the cooktop to the orifice holder defines a fixed engagement between the orifice holder and the burner box.

3. The method of claim 1, wherein the step of aligning the orifice holder includes positioning a locating surface on one of the opposing flanges with a corresponding locating feature that at least partially defines one of the slots of the plurality of slots.

4. The method of claim 3, wherein alignment of the locating surface and the locating feature defines a single orientation of the orifice holder with respect to the burner position.

5. The method of claim 1, wherein the step of passing the opposing flanges through the enlarged portion of each respective slot includes engaging a linear channel defined between the opposing flanges with a linear guide defined between the respective slots, wherein engagement of the linear channel and the linear guide defines a maximum insertion depth of the opposing flanges through the enlarged portion of each respective slot.

6. The method of claim 5, wherein the maximum insertion depth is defined by the opposing flanges passing substantially through the respective slots such that an angled leading surface of each of the opposing flanges is positioned entirely through an aperture of the respective slots.

7. The method of claim 1, wherein the step of passing the opposing flanges through an enlarged area of each respective slot includes engaging the opposing flanges with at least one deflecting tab to deflect the deflecting tab from a retaining state to an entry state, wherein the opposing flanges are able to be disposed through the respective slots when the at least one deflecting tab is in the entry state, and wherein the at least one deflecting tab returns to the retaining state when the opposing flanges are in the securing position, wherein the at least one deflecting tab serves to retain the opposing flanges in the securing position and prevent movement of the opposing flanges out of the securing position.

8. A method for assembling a burner for a cooking appliance, the method comprising steps of:

positioning an orifice holder proximate a pair of corresponding slots within a burner position of a burner box;

aligning the orifice holder such that opposing flanges of the orifice holder correspond to respective slots of the pair of slots, wherein one of the flanges of the opposing flanges is adapted to only pass through a first slot of the pair of slots and is further adapted to be free of passage through a second slot of the pair of slots, wherein alignment of the opposing flanges and the pair of slots defines a single orientation of the orifice holder with respect to the burner position;

passing the opposing flanges through an enlarged portion of each respective slot of the pair of slots; and sliding the opposing flanges in a linear direction through a narrowed portion of the respective slots in only one direction and into a securing position, wherein the orifice holder is at least partially secured in the narrowed portion.

9. The method of claim 8, further comprising steps of:

positioning a cooktop over the orifice holder, wherein a portion of the orifice holder extends through the cooktop; and affixing the cooktop to the orifice holder with at least one fastener, wherein attachment of the cooktop to the orifice holder defines a fixed engagement between the orifice holder and the burner box.

10. The method of claim 8, wherein the step of passing the opposing flanges through the enlarged portion of each respective slot includes engaging a linear channel defined between the opposing flanges with a linear guide defined between the respective slots, wherein engagement of the linear channel and the linear guide defines a maximum insertion depth of the opposing flanges through the enlarged portion of each respective slot.

11. The method of claim 10, wherein the maximum insertion depth is defined by the opposing flanges passing substantially through the respective slots such that an angled leading surface of each of the opposing flanges is positioned entirely through apertures of the respective slots.

12. The method of claim 8, wherein the step of passing the opposing flanges through the enlarged portion of each respective slot includes engaging the opposing flanges with at least one deflecting tab to deflect the deflecting tab from a retaining state to an entry state, wherein the opposing flanges are able to be disposed through the respective slots when the at least one deflecting tab is in the entry state, and wherein the at least one deflecting tab returns to the retaining state when the opposing flanges are in the securing position, wherein the at least one deflecting tab serves to retain the opposing flanges in the securing position and prevent movement of the opposing flanges out of the securing position.

* * * * *